US006513661B1

(12) United States Patent
Mogil

(10) Patent No.: US 6,513,661 B1
(45) **Date of Patent: *Feb. 4, 2003**

(54) PACK STRUCTURE

(75) Inventor: Melvin S. Mogil, Toronto (CA)

(73) Assignee: California Innovations Inc., Willowdale (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/865,474

(22) Filed: May 29, 2001

Related U.S. Application Data

(63) Continuation of application No. 09/568,022, filed on May 10, 2000, now Pat. No. 6,237,776, which is a continuation of application No. 09/122,088, filed on Jul. 24, 1998, now Pat. No. 6,092,661.

(30) Foreign Application Priority Data

Jul. 23, 1998 (CA) ..... 2243830

(51) Int. Cl.[7] ..... B65D 69/00

(52) U.S. Cl. ..... 206/579; 206/523; 206/315.1; 150/106; 150/112

(58) Field of Search ..... 206/579, 545, 206/523, 547, 315.1, 315.3, 315.5, 315.9; 150/106, 107, 112, 113, 117, 120, 129, 130; 224/153, 584; 383/117, 40; 190/109, 125, 127, 102, 103, 110; 62/457.1, 457.4, 457.5, 457.7, 457.9

(56) References Cited

U.S. PATENT DOCUMENTS

| | | | | |
|---|---|---|---|---|
| 2,827,096 A | | 3/1958 | Hinson | |
| 3,001,566 A | | 9/1961 | Lipsitz | |
| D234,181 S | | 1/1975 | Haswell | |
| 3,915,304 A | * | 10/1975 | Pasco et al. | 206/545 |
| 4,192,365 A | | 3/1980 | Siegel | |

(List continued on next page.)

OTHER PUBLICATIONS

"Get on Course with the Artic Zone® Golf Cooler™", one sheet, Artic Zone, 1996 Outer Circle Products, Ltd. AZC–0696–D.

*Primary Examiner*—Shian Luong
(74) *Attorney, Agent, or Firm*—Arent Fox Kintner Plotkin & Kahn, PLLC

(57) ABSTRACT

An insulated pack has a main, insulated compartment suitable for holding refreshments at either a warmed or chilled temperature. It also has another compartment for valuables that has receptacles for such objects as cellular telephone handsets, wallets, and keys. It has a reinforced web framework structure, and a carrying handle mounted on the lid. Use of two of these packs, allows a user to keep different objects at different temperatures. The pack is particularly useful for attachment to a golf bag or golf cart to provide cool drinks during a round of golf.

35 Claims, 7 Drawing Sheets

U.S. PATENT DOCUMENTS 4,378,866 A * 4/1983 Pelavin ..... 190/52
4,468,933 A 9/1984 Christopher
4,537,313 A * 8/1985 Workman ..... 206/545
D288,653 S 3/1987 Crymes
4,673,117 A 6/1987 Calton
4,767,039 A * 8/1988 Jacober ..... 224/151
4,925,071 A * 5/1990 Fleming et al. ..... 224/236
D312,530 S 12/1990 Gallen et al.
5,022,528 A 6/1991 Savoy
5,054,589 A 10/1991 Bomes et al.
D323,242 S 1/1992 Costello
D330,631 S 11/1992 Ledbetter
5,160,001 A * 11/1992 Marceau ..... 190/102
5,217,119 A * 6/1993 Hollingworth ..... 206/583
5,228,547 A 7/1993 Yoo
5,288,150 A * 2/1994 Bearman ..... 383/38
5,400,610 A 3/1995 Macedo
D366,812 S 2/1996 Collins et al.
D369,065 S 4/1996 Sylvestre et al.
5,505,307 A 4/1996 Shink
D371,942 S * 7/1996 Lippincott et al. ..... D7/605
5,567,055 A 10/1996 Smith
5,620,140 A 4/1997 Utter
5,640,855 A 6/1997 Crescenzo et al.
5,649,658 A 7/1997 Hoffman et al.
D387,198 S * 12/1997 Lehmann et al. ..... D3/217
5,722,253 A 3/1998 Todd
5,775,590 A 7/1998 Utter
5,842,571 A 12/1998 Rausch
5,884,768 A * 3/1999 Fox ..... 206/522
5,934,527 A * 8/1999 Von Neumann ..... 224/153
5,938,646 A * 8/1999 Carter ..... 220/524
5,967,415 A 10/1999 Utter
D419,770 S 2/2000 Mogil
D419,830 S 2/2000 Birutis et al.
6,092,661 A * 7/2000 Mogil ..... 206/579
6,116,045 A 9/2000 Hodosh et al.
6,237,776 B1 * 5/2001 Mogil ..... 206/579
6,238,091 B1 5/2001 Mogil

* cited by examiner

PACK STRUCTURE

This application is a continuation of Ser. No. 09/568,022 filed May 10, 2000 now U.S. Pat. No. 6,237,776, which is a continuation of U.S. patent application Ser. No. 09/122,088 filed Jul. 24, 1988 now U.S. Pat. No. 6,092,661.

This invention relates generally to portable packs that include a cooling compartment. In particular it relates to a kind of portable pack that can be used in a number of outdoor activities, such as, for example, while golfing.

BACKGROUND OF THE INVENTION

People enjoying outdoor activities often desire refreshment. In the summer the usual desire is for something cool to drink. In the spring or fall a warm beverage or snack may be preferred. It may be that those persons wishing refreshment are a considerable distance from the nearest tea shop or refreshment stand. They may have hiked some distance, or, in the case of golf, have reached a point far out on the course. In such circumstances it is convenient to be able to take a supply of cooled or heated refreshments along, for use as desired.

Another related problem, particularly when golfing as a visitor, is that secure locker facilities may not be available. It is often uncomfortable to golf with a wallet or set of keys contained in one or another pants pocket. A golfer may wish to keep his or her valuables, such as a wallet and car keys, close at hand during a round of golf, in a container that is within the golfer's view. In recent times the growing popularity of cellular telephones has made it possible for golfers, hikers, cross country skiers, picnickers or others, to remain in touch with their business colleagues while enjoying their outdoor activities, often so smoothly that others may be scarcely aware that they are not at the office. A cellular telephone is another object that is uncomfortable to carry when golfing or skiing, for example. Cellular telephones are easily stolen and highly marketable. For both convenience of use and discouragement of theft they should be kept relatively close to the user. At the same time, the ability to carry, for example, extra golf balls, chocolate bars, or gum, and to carry a score card or map in a visible position, with enhanced accessibility are further common needs.

It may be uncomfortable, or cumbersome to having a multiplicity of objects to carry. A number of items may fit within a golf bag, along with various clubs, but the golf bag may not be sufficiently large to carry some items, and some items may risk damage if placed in the golf bag itself. Also, a golf bag is not generally a convenient place to have a cooling medium, such as ice cubes. Further, the prospect of spilling lemonade, carbonated drinks, or beer, however much by accident, inside either the golf bag amongst the woods and irons, or in a pocket of the golf bag, is not one that would be greeted with enthusiasm by many golfers. A segregated auxiliary carrying case that is separately washable, that is mountable to the golf bag, and that can be carried with it is preferable. It would be even more advantageous to have a pack that can be mounted with the golf bag when the bag is carried on a wheeled carriage or in a golf cart. In this way a golfer's hands are not further encumbered.

SUMMARY OF THE INVENTION

In a first aspect of the invention there is a pack. It has an insulated compartment, an auxiliary compartment mounted next to the insulated compartment and a mount for attaching the pack to another object. The auxiliary compartment has a receptacle of a size for receiving a telephone handset, another receptacle of a size for receiving a wallet, and a closure securable in a closed position to conceal the contents of the receptacles.

In an additional feature of that aspect of the invention, the pack has a breadth corresponding to the thickness of a golf bag. In another additional feature of that aspect of the invention, the pack has a second mount for inhibiting swaying of the pack relative to the other object. In a further additional feature of that aspect of the invention, the pack includes a see-through pocket mounted externally to the auxiliary compartment. The see-through pocket is of a size to receive a golf ball.

In another additional feature of that aspect of the invention, the pack has a leading panel for placement adjacent to the golf bag, a pair of side regions, a trailing region, a bottom and a top. A see-through pocket is mounted to one of the side regions. The see-through pocket has an access lip that has a leading portion and a trailing portion. The leading portion has a greater altitudinal dimension relative to the pocket than the trailing portion.

In a further additional feature of that aspect of the invention, the pack has a lid. The lid has a handle. The handle has a reinforced attachment to the lid, whereby, when closed, the pack can be carried by the handle.

In a still further additional feature of that aspect of the invention, the insulated compartment has a substantially impermeable liner; and the liner can be inverted to facilitate washing. In yet another additional feature, the insulating compartment has a thermal transfer medium holder, and that holder is vented.

In still another further additional feature of that aspect of the invention, the auxiliary compartment includes a key holder. In a still further feature of that additional feature, the key holder includes a lanyard secured within said auxiliary compartment.

In another aspect of the invention there is an insulated pack. It has an insulated compartment. It has a first mount, for carrying the weight of the pack. The first mount is located on an upper region of the pack and is for attaching the pack to another object. The pack also has a second mount located on a lower region of the pack for attaching to the other object at a different location than the first mount.

In an additional feature of this aspect of the invention, the pack is reinforced at the location at which the first mount is attached to it. In another additional feature of the invention, the pack is reinforced at the location at which the second mount is attached to it. In a further additional feature, the first mount is a quick release hanging mount and the second mount is a cinch strap.

In another additional feature of that aspect of the invention, the pack further comprises a soft shell wall having a leading portion, a trailing portion, a pair of side portions, and a bottom portion. The soft shell wall has an opening in the upper region. The opening has a rim. The pack has a lid for closing the opening, and an upper girth reinforcement for reinforcing the rim. It also has a lower girth reinforcement for reinforcing the lower region. In a further additional feature, the lid has a carrying handle, is moveable to a closed position, and has a securable closure whereby, when closed, the pack can be carried by the handle. In a yet further additional feature of that aspect of the invention, the soft shell wall is an insulating wall and forms the boundary of the insulated compartment. The auxiliary compartment is mounted externally of the soft shell wall.

In a yet further again additional feature of that aspect of the invention, the pack includes a see through pocket located externally on the soft shell wall and has an access opening that is tapered from a tall leading portion to a short trailing portion. In again another additional feature of that aspect of the invention, the soft shell wall is an insulating wall bounding the insulated compartment. The insulated compartment has a substantially impermeable liner mounted to the rim. The liner can be inverted to facilitate washing.

In another aspect of the invention there is a pack for mounting to a golf bag. It has an insulated compartment and an auxiliary compartment having a closure for concealing the contents thereof. It also has a first mount for carrying the vertical load of the pack located on an upper region of the pack for attaching the pack to the golf bag. There is a second mount located on a lower region of the pack for attaching to the golf bag at a different location than the first mount.

In another aspect of the invention there is an insulated pack. It has a flexible, soft shell wall structure having a flexible insulated layer, and having a bottom portion, a top portion, and a sidewall member. The sidewall member has a leading portion, a trailing portion and left and right hand side portions. The leading, trailing and left and right hand side portions extend between the top and bottom portions. The portions of the soft shell wall structure co-operate to define therewithin an insulated compartment.

The top portion includes a lid that is moveable from a closed position to an open position to give access to the insulated compartment. The sidewall member has a height and a breadth. The height is greater than the breadth, and the trailing portion is arcuate when viewed from above. A liner is mounted within the compartment to receive objects introduced when the lid is in the open position. The liner is moveable to an inverted position to facilitate washing thereof.

A lifting member is attached to the sidewall member. A secondary wall structure is mounted to the trailing portion of the sidewall member. The secondary wall structure stands outwardly of the trailing portion of the sidewall member and defines an auxiliary compartment therewithin. The secondary wall structure has an auxiliary compartment closure member operable to give access to the auxiliary compartment.

In an additional feature of that aspect of the invention, the pack further comprises an external peripheral reinforcing band extending about the sidewall member adjacent to the upper margin. In another additional feature of that aspect of the invention, the pack further comprises an external peripheral reinforcing band that extends about the sidewall member adjacent to the bottom portion of the flexible soft shell wall structure. In a further additional feature of that aspect of the invention, the lid has a hingedly mounted edge and the closure member is a tracked fastener mounted peripherally to the lid opposite to the hingedly mounted edge.

In a still further additional feature of that aspect of the invention, the lid is moveable to the closed position relative to the insulated compartment. The lid has an inside surface facing the insulated compartment when the top portion is in the closed position and has a peripheral bead formed thereabout. The bead extends downwardly relative to the inside surface of the top when the top portion is in the closed position. The sidewall member has an upwardly extending peripheral bead formed thereabout. The upwardly extending bead stands in opposition to the downwardly extending bead of the lid when the lid is in the closed position.

In still another additional feature of that aspect of the invention, the leading portion has an upper region proximate to the top portion and a lower region proximate to the bottom portion of the flexible soft shell wall structure. The upper region of the leading portion has a lateral reinforcing band mounted thereto. The lateral reinforcing band extends between the left and right hand side portions of the sidewall member.

In yet another additional feature of that aspect of the invention, the lifting member is attached to the upper region of the leading portion at an attachment location. The attachment location is reinforced by the lateral reinforcing band. In still another additional feature of that aspect of the invention, the leading portion has an upper region proximate to the top portion and a lower region proximate to the bottom portion of the flexible soft shell wall structure. The lower region of the leading portion has a lateral reinforcing band mounted thereto that extends between the left and right hand side portions of the side wall member.

In a still further additional feature of that aspect of the invention, the leading portion has an upper region proximate to the top portion and a lower region proximate to the bottom portion of the flexible soft shell wall structure. The upper region of the leading portion has an upper lateral reinforcing band extending between the left and right hand side portions of the sidewall members. The lower region of the leading portion has a lower lateral reinforcing band extending between the left and right hand side portions of the sidewall member. In yet another additional feature of that aspect of the invention, the side pocket has a leading edge, a trailing edge and an access lip extending therebetween. The trailing edge is shorter than the leading edge.

In still another additional feature of that aspect of the invention, the auxiliary compartment has a left side wall and a right side wall. The left and right side walls extend away from the trailing portion of the sidewall member. An auxiliary compartment trailing wall extends between the left and right hand side walls. The trailing wall portion has an upper region and a lower region. The upper region of the trailing wall has an upwardly extending flap. The flap has a detachable margin moveable to an open position to give access to the auxiliary compartment. The flap has an upper margin, a left hand side margin, and a right hand side margin forming an inverted U-shaped boundary along which the auxiliary compartment closure member is mounted.

In another aspect of the invention, there is a cooler. It has a top, a bottom, and an insulated sidewall extending between the top and the bottom to define an insulated compartment therewithin. The sidewall has a height and a breadth. The height is greater than the breadth. The sidewall has a first portion and a second portion. The second portion is arcuate. The first and second portions of the sidewall are connected in a manner such that the sidewall has a D-shaped cross-section. The top is attached to the first portion of the sidewall. The top is attached to the second portion of the sidewall by a releasable fastener. The releasable fastener is operable to permit the top to move to an open position relative to the insulated compartment.

In an additional feature of that aspect of the invention, there is a secondary wall structure mounted to the arcuate portion of the sidewall. The secondary wall structure defines an auxiliary compartment therewithin. The secondary wall structure has first and second side portions extending vertically along, and standing outwardly of, the arcuate portion of the sidewall. The secondary wall structure has an intermediate wall extending between the first and second side portions of the secondary wall structure. The intermediate wall has a lower portion and an upper portion. The upper portion has a flap. The flap is releasable along margins thereof to give access to the auxiliary compartment. In another additional feature of that aspect of the invention, the lower portion of the intermediate wall of the secondary wall structure has a first region attached to the arcuate portion of the sidewall and extending away therefrom. A second region extends upwardly from the first region toward the flap.

In still another additional feature of that aspect of the invention, the cooler further comprises a liner mounted inwardly of the sidewall. The liner has a peripheral margin defining an opening thereof. The peripheral margin of the liner is mounted to the sidewall. The liner is positionable within the sidewall to contain objects introduced through the opening. The liner is moveable to an inverted position, and, in the inverted position, the peripheral margin of the liner remains attached to the sidewall and the liner extends outside the insulated compartment to facilitate washing thereof.

In yet another additional feature of that aspect of the invention, The top is moveable to a closed position relative to the insulated compartment. The top has an internal surface facing the insulated compartment when the top is in the closed position and has a peripheral bead formed thereabout. The bead extends downwardly relative to the inside surface of the top when the top is in the closed position. The sidewall has an upper margin adjacent to the top. The upper margin has a peripheral bead formed thereabout. The bead stands in opposition to the downwardly extending bead of the top when the top is in the closed position.

In still another aspect of the invention, there is a cooler comprising a bottom, and a flexible insulated sidewall extending upwardly of the bottom to define an insulated compartment therewithin. The sidewall has an upper margin distant from the bottom. The bottom has, in plan view, a D-shaped periphery. The sidewall has a lower margin mated to the D-shaped periphery of the bottom. The upper margin has a first portion, and a second portion opposed to the first portion, the second portion being arcuate. The sidewall has a height and a breadth, the height being greater than the breadth. A top is attached to the first portion of the upper margin. The top is moveable to an open position to permit objects to be placed in the insulated compartment.

In an additional feature of that aspect of the invention, the cooler further comprises a liner mounted to the sidewall. The liner can be positioned within the insulated compartment. The liner is impermeable to liquids and is moveable to an inverted position. In said inverted position, a portion of said liner extends outside the compartment to facilitate washing of the liner.

In another additional feature of that aspect of the invention, the top of the cooler is moveable to a closed position relative to said insulated compartment. The top has an inside surface facing said insulated compartment when the top is in the closed position, and has a peripheral bead formed thereabout. The bead extends downwardly relative to the inside surface of the top when the top is in the closed position. The upper margin of the sidewall has an upwardly extending peripheral bead formed thereabout. The upwardly extending bead stands in opposition to the downwardly extending bead of the top when said top is in said closed position.

DETAILED DESCRIPTION OF THE INVENTION

Figure 1:
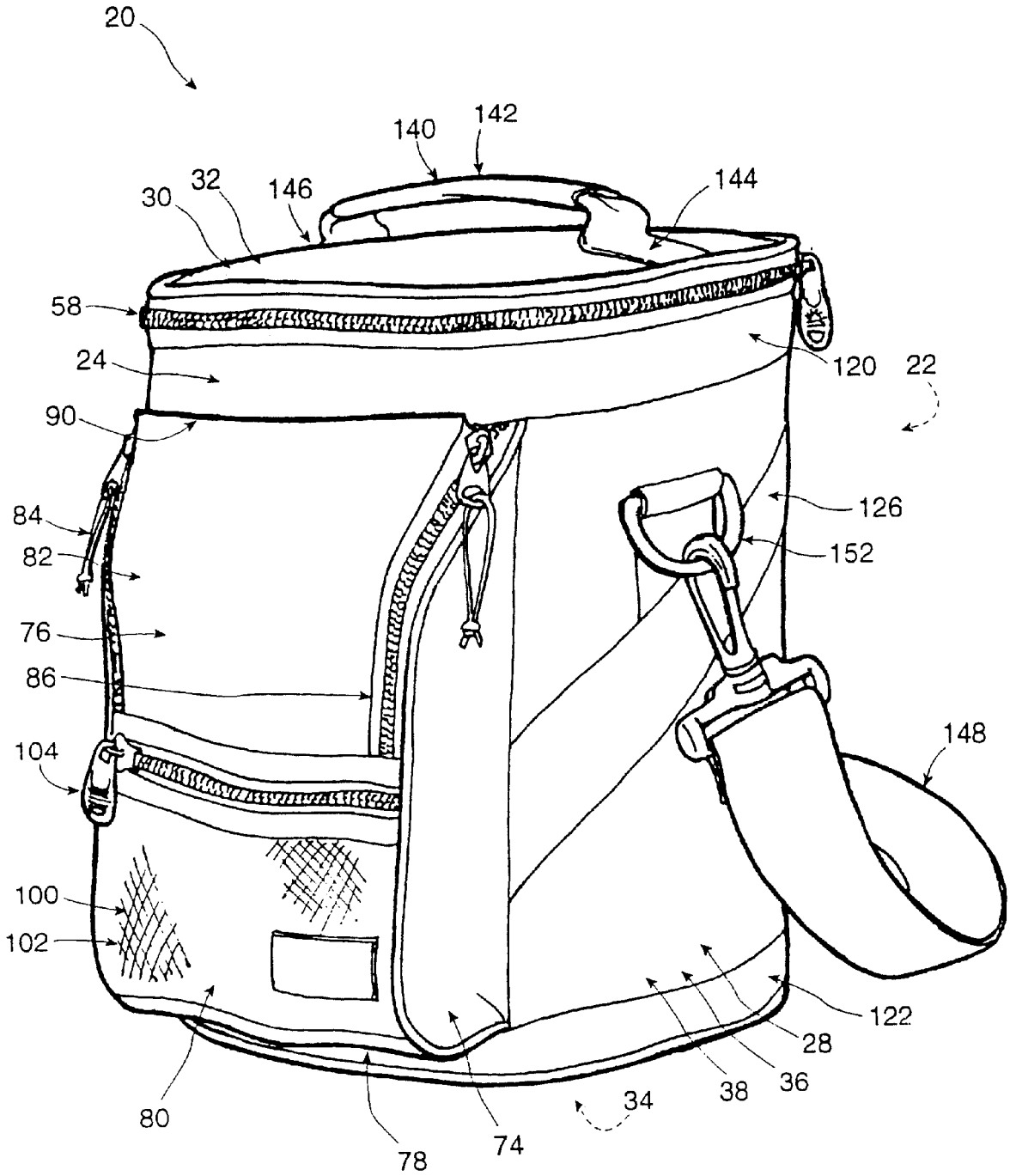
FIG. 1 is a perspective view of a preferred embodiment of a pack according to the present invention.

The description which follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

Figure 2:
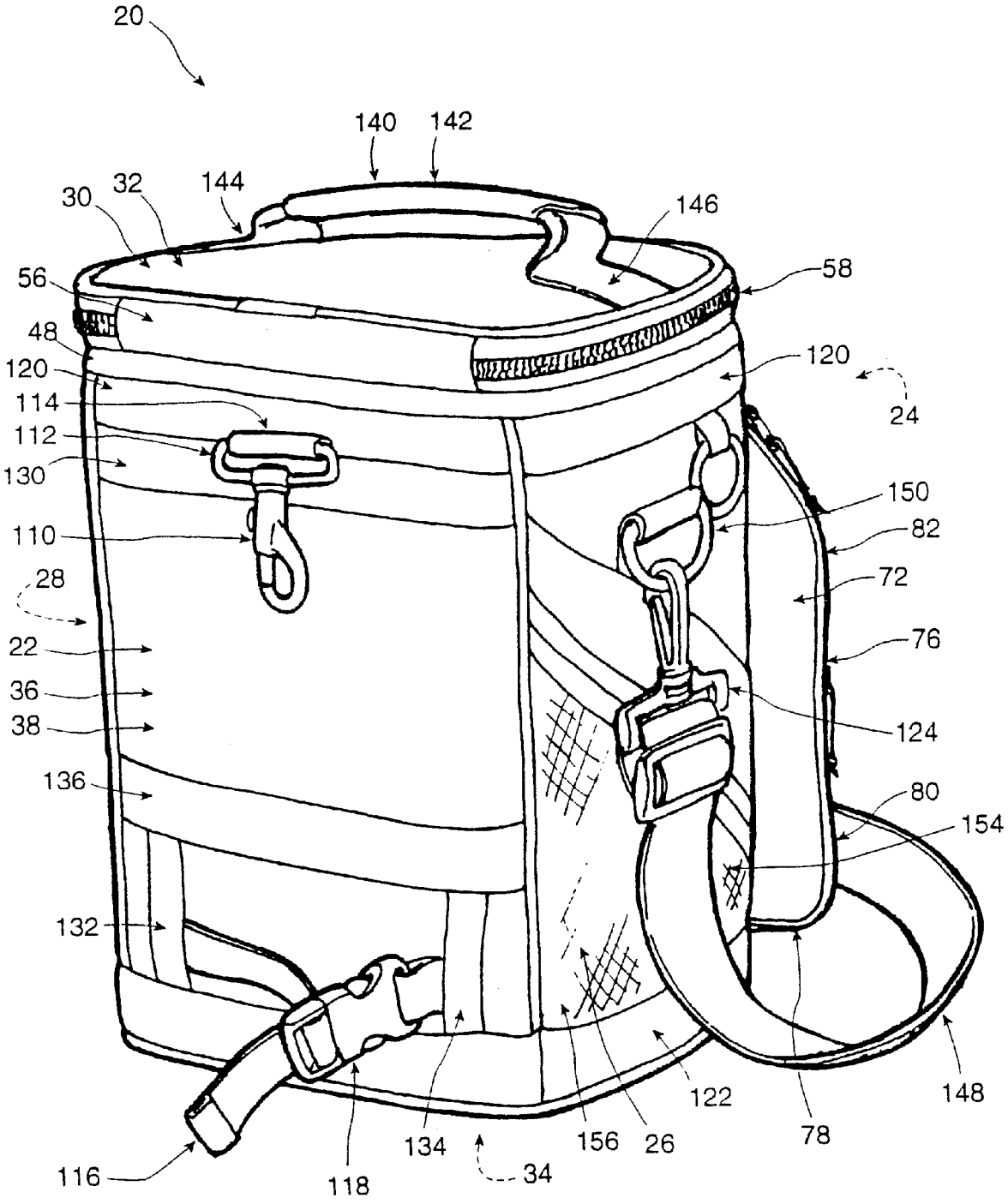
FIG. 2 is another perspective view of the pack illustrated in FIG. 1 with a lid of the pack in an open position.
Figure 3:
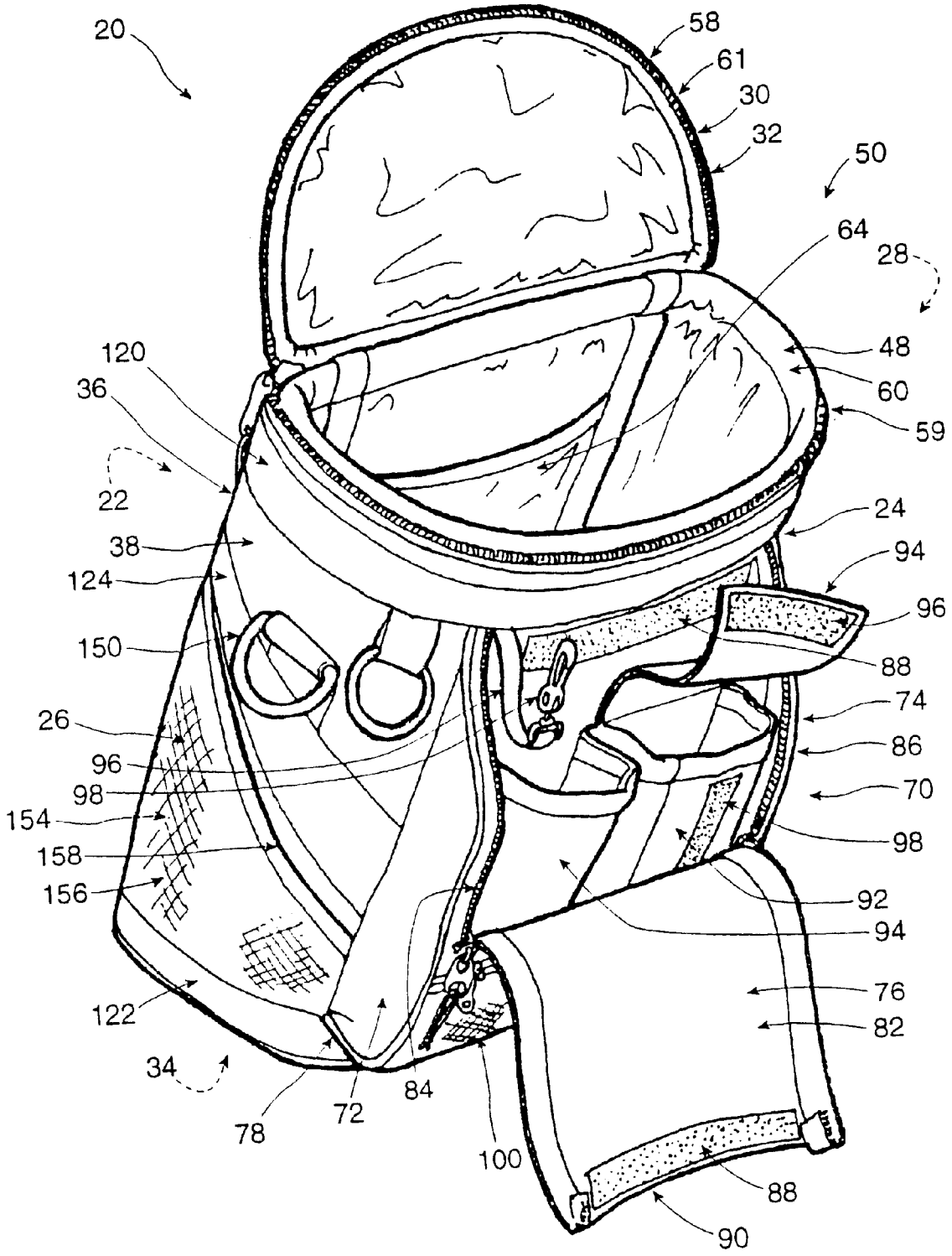
FIG. 3 is a perspective view of the pack illustrated in FIG. 1 with the lid and an external compartment open.
Figure 7:
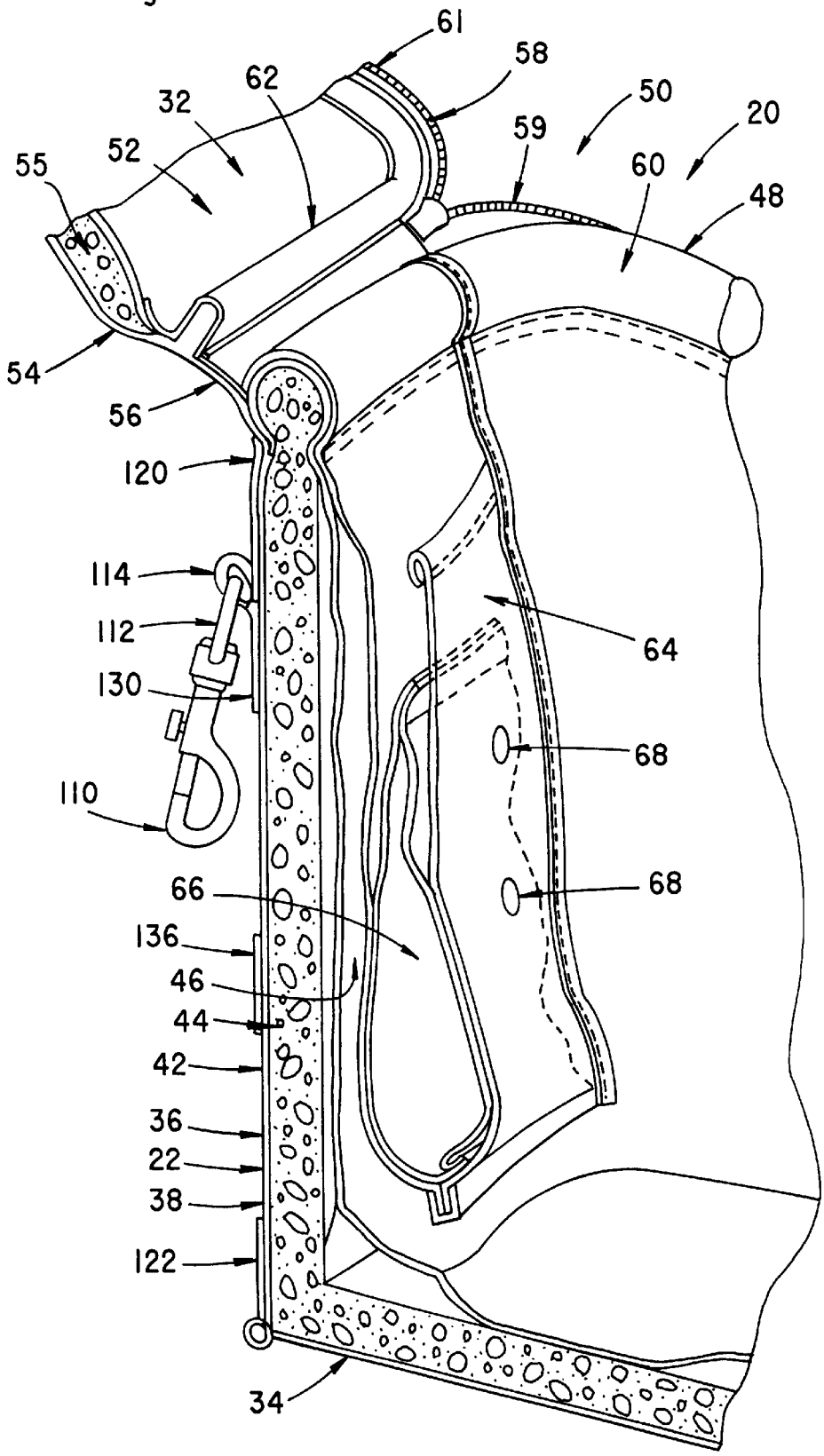
FIG. 7 illustrates a partial sectional view of the pack of FIG. 1 showing a detail of a coolant pouch and a detail of the wall construction of the pack.

Referring to FIGS. 1–3, an insulated pack having a shape that is generally similar to a golf bag, but on a smaller scale, is shown generally as 20. It has a leading portion 22, a trailing portion 24, a pair of left and right hand side portions 26 and 28, a top portion 30 having a lid 32, and a bottom portion 34. The pack 20 has an insulated compartment 36 bounded by a modestly flexible soft shell insulating wall 38, as shown in FIG. 7. The breadth of pack 20, that is, the overall width when viewed from the leading or trailing directions, is approximately 8.5 inches when empty. When undeformed, pack 20 has a gently bulging D-shaped cross section when seen from above, similar to a golf bag, although this may change somewhat when loaded. The breadth is roughly the same as the thickness of a middling to large size of golf bag. Referring briefly to the detail of FIG. 7, wall 38 has an outer covering 42 of webbed construction, and an internal closed cell foam layer 44 within the outer covering 42.

Further, liner 46 is not, in the example illustrated, fixed to a bottom of the compartment 36, but can be pulled out of the compartment 36 to an inverted position, while still remaining attached at a rim 48, to facilitate washing, such as, for example, with soap, and to facilitate drying, to discourage the growth of fungus therein and the like. Liner 46 has a single circumferential seam to join a bottom face, and a single wall seam running from the circumferential bottom seam to rim 48. In an optional alternative, liner 46 could be made from a polymer that has been impregnated with an antimicrobial compound prior to fabrication, a desirable feature for this kind of liner. The top of compartment 36 is formed by generally D shaped lid 32. Lid 32 also has a through section structure of a flexible reflective inner layer 52, a flexible skin in the nature of a canvas or webbing covering 54, and a flexible closed cell insulation layer 55, which is somewhat similar to layer 44 described above, captured inbetween. Lid 32 is joined to the main body of pack 20, along the roughly straight side of the "D" shape, by a hinge in the nature of a flexible fabric hinge 56, and a peripheral tracked closure in the nature of a zipper 58 having a pair of opposed zipper cars.

Rim 48 has a resiliently spongy beaded lip 60 wrapped within the upper edge of liner 46, adjacent to the set of zipper teeth 59 of zipper 58 that is mounted to the main body of pack 22. Lid 32 has a mating generally "D" shaped peripheral lip 62 immediately next to the set of zipper teeth 61 of zipper 58 mounted to lid 32. When the zipper 58 is closed, lip 62 is drawn down to bear on the outside surface of beaded lip 60, encouraging a sealing contact to be formed.

Within main compartment 36 a thermal transfer storage medium compartment is provided against a leading wall portion of insulating wall 38 by the use of a sack 64 for holding the thermal storage medium 66. Thermal storage medium 66 may be used as a source of heat to be transferred into the contents of compartment 36, that is, to maintain a warm temperature distribution in compartment 36. Alternatively, the thermal storage medium 66 can be used as a heat sink to maintain a cool, chilled, or freezing temperature distribution in the contents of compartment 36, as circumstances may require. Sack 64 has an array of perforations 68 to allow air to circulate through sack 64 more easily, thereby facilitating drying of the sack 64 after washing.

The pack 20 also has an auxiliary compartment in the nature of a valuables compartment 70, that is mounted to the trailing portion 24 externally of the soft shelled insulating wall 38. Compartment 70 has a pair of left and right hand side portions 72 and 74 that are connected to and extend vertically along, and rearwardly from the trailing portion of insulating wall 38; and a single piece trailing wall 76 extending between the distal extremities of side portions 72 and 74. In the preferred embodiment wall 76 is, like the rest of cover 42, made of a 600 denier polyester fabric, treated, as are all external surfaces of pack 20, to be stain and water resistant. Other wall fabrics can be used, such as leather or leather-like vinyl.

Wall 76 has a lower or underside area 78 that meets, and is joined to, the trailing portion of insulating wall 38. Underside area 78 forms the bottom of compartment 70. Wall 76 also has a medial, outer area 80 that extends approximately two-fifths of the way up compartment 70. An upper area 82 of wall 76, in the nature of a flap, is contiguous with outer area 80 on one edge, and has closures on the remainder of its periphery. Two of those closures are left and right hand vertical zippers, 84 and 86, that join with the uppermost pails of the distal edges of side portions 72 and 74. The third is a hook and eye fabric closure 88 for releasably attaching an end lip 90 of wall 76 to insulated wall 38 just below rim 48.

Referring to FIG. 3, in which closures 84, 86 and 88 are undone, and upper area 82 lies open, a first receptacle, in the nature of a soft sided, durable fabric pocket 92 with a covering flap 94 has a horizontal hook and eye fastener part 96 mounted on its underside just inside its lip, for mating with a vertically aligned mating hook and eye fabric fastener part 98, the combination of orientations providing an adjustable size, and flexibility inclosure position. Pocket 92 is of a size for carrying a cellular telephone handset, having a girth of approximately 5.5 inches comprised of approximately 1.25 inches deep sides and approximately 3.0 inches width and a depth of approximately 6.5 inches from bottom to lip. The interior of pocket 92 is lined with a cushioning material. Pocket 92 can be used for other objects than cellular telephones such as for sunglasses, a glasses case, and the like.

An adjacent receptacle in the nature of a soft-sided, open top pocket 94, without cover, has a convenient size of approximately 4–5 inches in girth and approximately 5.5 inches in depth for holding a deodorant container, or other object of similar size. It can, for example, be used as a storage space for a carrying strap. Adjacent to pocket 94 is a key holder in the nature of a lanyard 96 having one end fastened within compartment 70 just below rim 48. At its other, depending end lanyard 96 has a quick-release spring clip 98 for hooking about the ring of a key chain. Use of a strap, such as lanyard 96, makes it easy to retrieve keys, rather than having to fish around the bottom of compartment 70. The remaining enclosed space within medial outer area 80 and above underside area 78 has a height of approximately 4 inches, and a width of approximately 7 inches between the piping along the outer edges of side portions 72 and 74, leaving space for a wallet, or other items.

Other arrangements of closures are possible for auxiliary compartment 70. A single three sided zipper closure, with one or two zipper cars could be used, and the hook and eye fastener eliminated. Other kinds of fasteners, such as laces and grommets, interference fit seals, snaps, buttons, and the like are possible. The present arrangement is preferred.

Similarly, other arrangements of receptacles and key holders, or like items can be used, although the present configuration is convenient, and preferred.

A vented, see-through pocket 100 is mounted externally to medial outer area 80, and is of a size for accommodating, for example, extra golf balls, gum, candy bars or other items. Open form mesh 102 permits objects in pocket 100 to dry more easily. Pocket 100 is closed by a sliding closure in the form of zipper 104.

A main attachment, suitable, for example, for hanging pack 20 from a golf bag, or for clipping pack 20 to a golf bag or golf cart, is shown as a quick release brass hook fitting 110 is mounted to an upper region of pack 20 on leading portion 22. Hook fitting 110 is free to revolve within its hinge fitting 112, which itself is able to swing up and down within the confines of a broad loop of webbing 114.

A second attachment, suitable for tightening to another fastening location of a golf bag or golf cart, in the nature of an adjustable cinch strap 116 is mounted to a lower region of pack 20, also on leading portion 22. Strap 116 has a releasable catch 118, and can be used to tighten the lower region of pack 20 to a golf bag, golf cart, or other object, to restrain its swaying motion about the main attachment at hook fitting 110.

It is anticipated that a significant use of main insulated compartment 36 will be for carrying cans of liquid, such as carbonated beverages, fruit drinks, or beer, whether or not accompanied by ice cubes or crushed ice. Inasmuch as the preferred is embodiment illustrated has a capacity of 12 cans of 385 milliliters and ice, a load of 10 to 12 pounds (50 to 55 N) would not be unexpected. The height of the preferred embodiment illustrated to the lip of rim 48 is approximately 12 inches. Liner 46 is not taut when lying against the inner walls of compartment 36. That is, liner 46 has some slack, and is somewhat elastic in any event. Consequently load is taken up primarily, if not entirely, in soft shelled insulating wall 38, and more specifically, principally in outer covering 42 of wall 38.

The main attachment at hook fitting 110 is able to carry the entire weight of pack 20, and the second attachment at cinch strap 116 inhibits swaying of pack 20 about the first attachment. Outer covering 42 has an upper reinforcing band 120 extending externally about the periphery of insulating wall 38 next to rim 48. A lower reinforcing band 122 extends externally about the bottom edge of pack 20 where leading portion 22, trailing portion 24, and side portions 26 and 28 meet bottom portion 34, that is to say, about the lower region of pack 20.

A pair of left and right hand web doublers 124 and 126 commence at a relatively high location at the leading edges of respective side portions 26 and 28, extend across the surface of those sides, and terminate at a lower location on the trailing edge of side portions 26 and 28. That is, they extend from the leading edge of the upper region to the trailing edge of a lower region of pack 20.

The attachment of hook fitting 110 to pack 20 is reinforced by an upper lateral reinforcing band 130, in addition to upper reinforcing band 120, the effect being to spread the stress concentration out. Lateral reinforcing band 130 ends at the leading edges of side portions 26 and 28, close to the leading ends of doublers 124 and 126, yielding a reinforced load path between the lower region of pack 20 and hook fitting 110.

Similarly, each end of cinch strap 116 is sewn under a vertical left or right hand root reinforcement 132 or 134, each of these in turn leading to either lower reinforcing band 122 or a lower lateral reinforcement band 136, whose ends reach to the leading edges of side portions 26 and 28.

For ease and comfort of carrying pack 20 by hand, lid 32 is provided with a carrying handle 140 having a padded bail 142, and a pair of webbing feet 144 and 146 that extend filly to opposite points on the periphery of lid 32, such that loads carried through handle 140 are transmitted not only through the outer covering layer of lid 32 but also through the reinforcement of feet 144 and 146. At the edge of lid 32 the presence of upper reinforcing band 122 helps to spread the load more evenly to and from the vertical sidewalls formed by portions 22, 24, 26, and 28. Alternatively, pack 20 can be carried by a shoulder strap 148 fastened by spring clips to D-shaped rings 150 and 152, mounted on either of sides 26 and 28.

Left hand side portion 26 is provided with a trapezoidally shaped external pocket 154 having a breathing, see-through mesh 156 similar to mesh 102. A scorecard, or map, placed in this pocket can be seen for retrieval. Lip 158 of pocket 154 is set on a rake angle, yielding a somewhat larger opening for sliding a scorecard in, without having as carefully to fit it into a narrow opening as might otherwise be the case for a square cut pocket.

Figure 4:
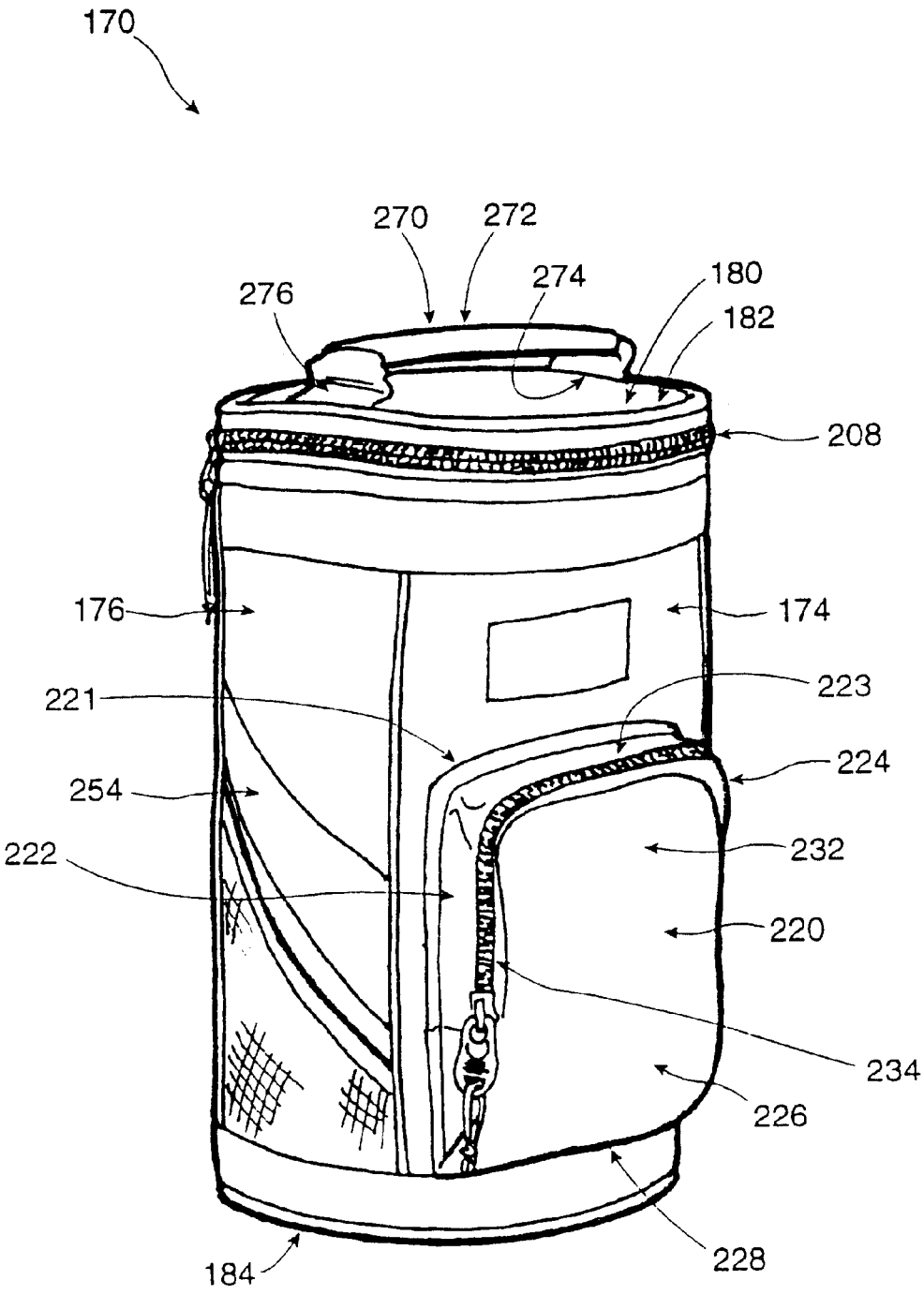
FIG. 4 is a perspective view of another embodiment of a pack according to the present invention.
Figure 5:
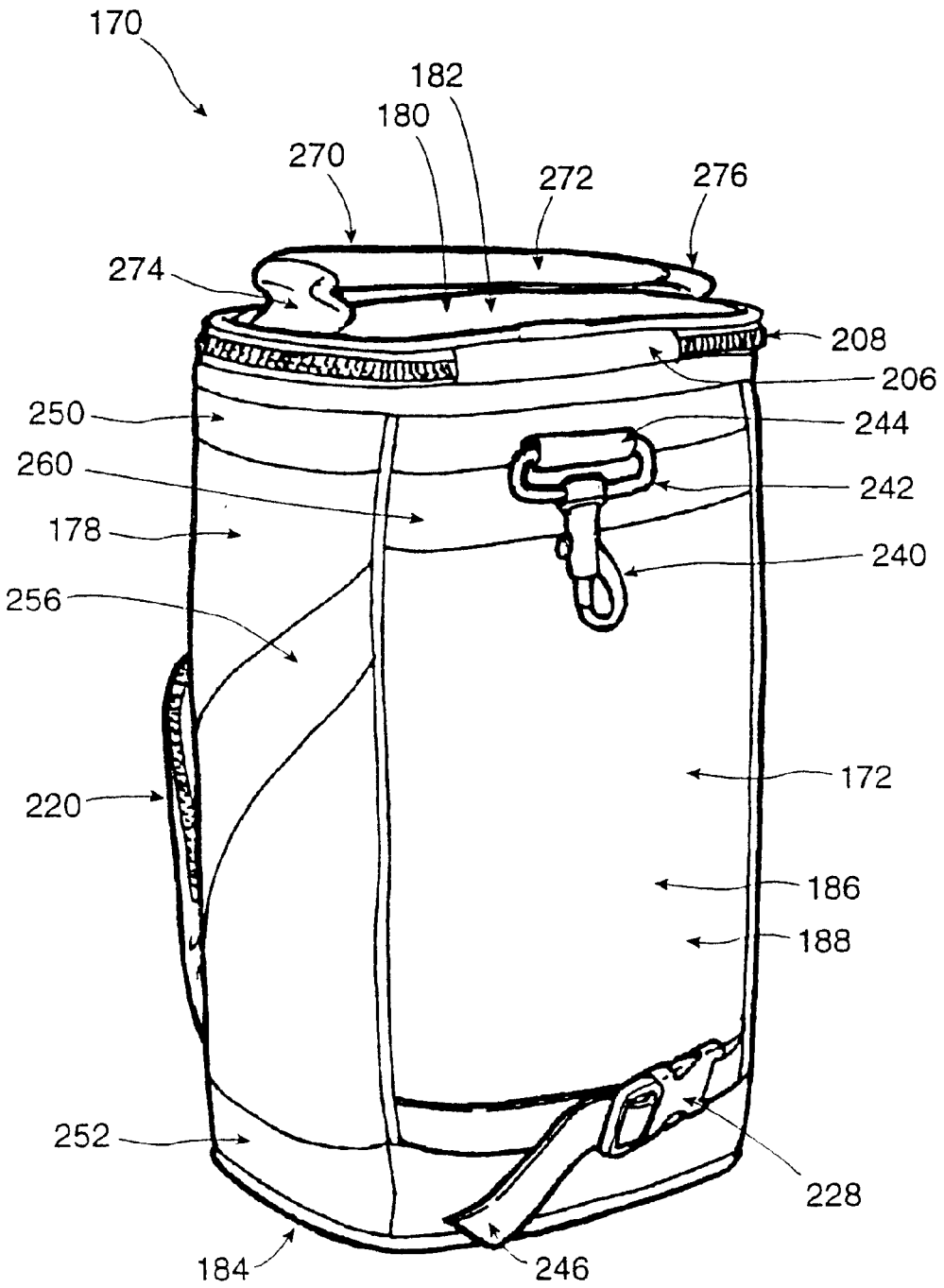
FIG. 5 illustrates, another perspective view of the pack illustrated in FIG. 4.
Figure 6:
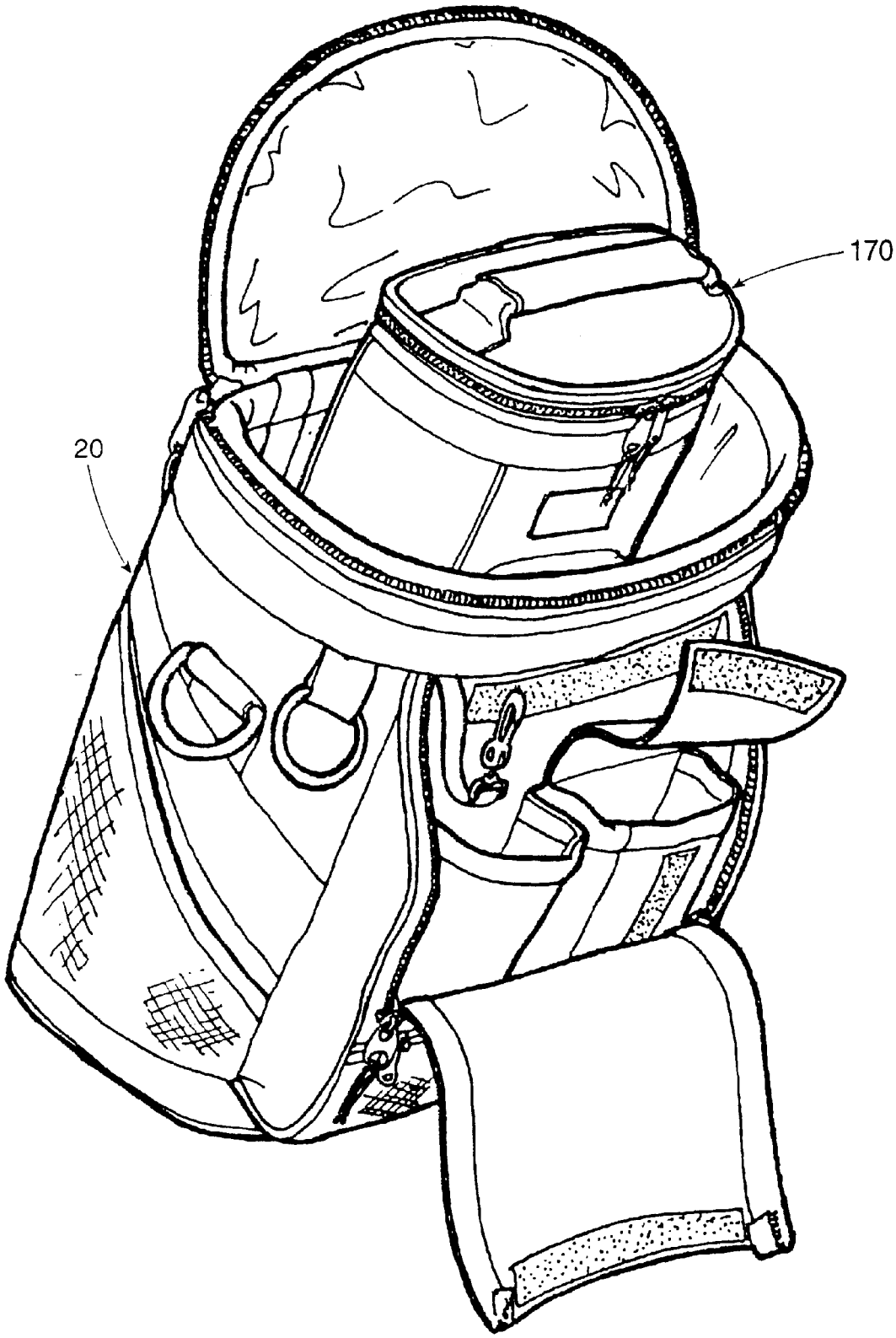
FIG. 6 illustrates a top view of the pack of FIG. 2, in an open state, with the pack of FIG. 4 partially nested therein.

Referring to FIGS. 4 and 5, a second insulated pack, is shown generally as 170. In this embodiment, pack 170 is of a size for carrying 5 cans. It has a leading portion 172, a trailing portion 174, a pair of left and right hand side portions 176 and 178, a top portion 180 having a lid 182, and a bottom portion 184. The pack 170 has an insulated compartment 186 bounded by a modestly flexible soft shell insulating wall 188, whose wall construction is substantially the same as that shown in FIG. 7 and discussed above. The breadth of pack 170, that is, the overall width when viewed from the leading or trailing directions, is approximately 6.5 inches when empty. When undeformed, pack 170 has a gently bulging D-shaped cross section when seen from above again, not dissimilar in general appearance to a golf bag. The breadth is approximately the same as the thickness of a small size of golf bag, and, is such that pack 170 can nest comfortably compartment 36 of pack 20. This is shown in FIG. 6.

The top of compartment 186 is formed by generally D-shaped lid 182. Lid 182 has substantially the same layered construction as lid 32. Lid 182 is joined to the main body of pack 170, along the roughly straight side of the "D" shape, by a hinge in the nature of a flexible fabric hinge 206, and a peripheral tracked closure in the nature of a zipper 208 having a pair of opposed zipper cars. The manner of closing lid 182 on compartment 186 of pack 170 is the same as for lid 36 of pack 20. Further, the same kind of substantially impermeable liner and thermal storage medium are used. The thermal storage medium is held in a sack like sack 64.

The insulated pack 170 also has an auxiliary compartment in the nature of a valuables compartment 220, that is mounted to trailing portion 174, externally of soft shelled insulating wall 188. Compartment 220 has a generally downwardly opening, U-shaped member 221 that has pair of left and right hand side portions 222 and 224 that are connected to and extend vertically along, and rearwardly from the trailing portion of insulating wall 188 and a top cross portion 223 extending between them. Compartment 220 also has a single piece trailing wall 226 extending between the distal extremities of side portions 222 and 224. Wall 226 is made of canvas. Wall 226 has a lower or underside area 228, that meets and is joined to the trailing portion of insulating wall 188. Underside area 228 forms the bottom and lower trailing face of compartment 220. Wall 226 also has an upper area 232, being a flap contiguous with underside area 228 on one edge. Upper area 232 has a three sided wrap-around closure, being a zipper 234 that joins the corresponding edge of U-shaped member 221. As described above in the context of pack 20, compartment 220 has internal receptacles lined with cushioning for receiving valuables, glasses, keys, and so on.

A main attachment, suitable, for example, for hanging pack 170 from a golf bag, or for clipping pack 170 to a golf bag or golf cart, is shown as a quick release brass hook fitting 240, mounted to an upper region of pack 170 on leading portion 172. Hook fitting 240 is free to revolve within its hinge fitting 242, which itself is able to swing up and down within the confines of a broad loop of webbing 244.

A second attachment, suitable for tightening to another fastening location of a golf bag or golf cart, in the nature of an adjustable cinch strap 246 is mounted to a lower region of pack 170, also on leading portion 172, but in this case being rooted at the outside edges of leading portion 172 where they meet the leading edges of side portions 176 and 178. Strap 246 has a releasable catch 248, and can be used to tighten the lower region of pack 170 to a golf bag, golf cart, or other object, to restrain its swaying motion about the main attachment at hook fitting 240.

Outer covering 192 has an upper reinforcing band 250 extending externally about the periphery of insulating wall 188 next to rim 198. A lower reinforcing band 252 extends externally about the bottom edge of pack 170 where leading portion 172, trailing portion 174, and side portions 176 and 178 meet bottom portion 184, that is to say, about the lower region of pack 170.

A pair of left and right hand doublers, 254 and 256 commence at a relatively high location at the leading edges of respective side portions 176 and 178, extend across the surface of those sides, and terminate at a lower location on the trailing edge of side portions 176 and 178.

The attachment of hook fitting 240 to pack 170 is reinforced by an upper lateral reinforcing band 260, in addition to upper reinforcing band 250, the effect being to spread the load out. Lateral reinforcing band 250 ends at the leading edges of side portions 176 and 178, close to the leading ends of doublers 254 and 256, yielding a reinforced load path between the lower region of pack 170 and hook fitting 240.

Lid 182 is provided with a carrying handle 270 having a padded bail 272, and a pair of webbing feet 274 and 276 that extend fully to opposite points on the periphery of lid 182, such that loads carried through handle 270 are transmitted not only through the outer covering layer of lid 182 but also through the reinforcement of feet 274 and 276. At the edge of lid 182 the presence of upper reinforcing band 252 helps to spread the load more evenly to and from the vertical sidewalls formed by portions 172, 174, 176, and 178.

Left hand side portion 176 is provided with a trapezoidally shaped external pocket 284 having a breathing, see-through mesh 286 similar to mesh 102. Lip 288 of pocket 284 is set on a rake angle.

A preferred embodiment has been described in detail and a number of alternatives have been considered. As changes in or additions to the above described embodiments may be made without departing from the nature, spirit or scope of the invention, the invention is not to be limited by or to those details, but only by the appended claims or their equivalents.

What is claimed is:

1. A pack comprising:

a flexible, soft shell wall structure having a flexible insulated layer, a bottom portion, a top portion, and a sidewall structure, wherein said sidewall structure has a leading portion, a trailing portion and left and right side portions, said leading, trailing and left and right side portions of said sidewall structure extending between said top and bottom portions, wherein said portions of said soft shell wall structure co-operate to define therewithin an insulated compartment, said sidewall structure leading, trailing and left and right side portions having upper margins, said upper margins co-operating to define an opening of said insulated compartment, wherein said top portion being a hingedly mounted lid, said lid being moveable to an open position to expose said opening of said insulated compartment, said sidewall structure also having a rim extending about said opening;

a liner mounted to said rim, said liner being positionable within said compartment and moveable to an inverted position to facilitate washing thereof;

a lifting member attached to said leading portion of said flexible soft shell wall structure;

said sidewall structure having a height, a depth, and a breadth, said height being greater than either of said depth and said breadth;

a secondary wall structure mounted to said trailing portion of said flexible soft shell wall structure to define an auxiliary compartment, said secondary wall structure having an auxiliary compartment closure member operable to give access to said auxiliary compartment, wherein said auxiliary compartment has a first receptacle mounted therein, a second receptacle mounted therein, and said auxiliary compartment closure member is securable in a closed position to conceal the contents of said first and second receptacles.

2. The pack according to claim 1, wherein said pack has a see-through pocket mounted to one of said side portions of said sidewall structure.

3. The pack according to claim 2, wherein said see-through pocket has an access lip having a leading portion and a trailing portion, said leading portion being more distant from said bottom portion of said pack than said trailing portion.

4. An insulated pack comprising:

a flexible, soft shell wall structure having a flexible insulated layer, and having a bottom portion, a top portion, and a sidewall member;

said sidewall member having a leading portion, a trailing portion and left and right hand side portions;

said leading, trailing and left and right hand side portions extending between said top and bottom portions;

said portions of said soft shell wall structure co-operating to define therewithin an insulated compartment;

said top portion including a lid, said lid being moveable to an open position to give access to said insulated compartment;

said sidewall member having a height and a breadth, said height being greater than said breadth, and said trailing portion being arcuate such that, when viewed from above, said sidewall member has a D-shaped cross-section;

a liner mounted within said compartment to receive objects introduced when said lid is in said open position, said liner being moveable to an inverted position to facilitate washing thereof;

a lifting member attached to said sidewall member; and a secondary wall structure mounted to said trailing portion of said sidewall member, said secondary wall structure standing outwardly of said trailing portion of said sidewall member and defining an auxiliary compartment therewithin; said secondary wall structure having an auxiliary compartment closure member operable to give access to said auxiliary compartment.

5. The pack according to claim 4, wherein said sidewall member has an upper margin and an external peripheral reinforcing band that extends about said sidewall member adjacent to said upper margin.

6. The pack according to claim 4, wherein said pack further comprises an external peripheral reinforcing band that extends about said sidewall member adjacent to said bottom portion of said flexible soft shell wall structure.

7. The pack according to claim 4, wherein:

said sidewall member has an upper external peripheral reinforcing band and a lower external peripheral reinforcing band;

said upper reinforcing band extends about said sidewall member adjacent to said top portion; and said lower reinforcing band extends about said side wall member adjacent to said bottom portion of said flexible soft shell wall structure.

8. The pack according to claim 4, wherein said flexible soft shell wall structure has an outer layer made of polyester fabric.

9. The pack according to claim 4, wherein said lid has a carrying handle attached to said lid.

10. The pack according to claim 4, further comprising a closure member operable to secure said lid in a closed position relative to said insulated compartment.

11. The pack according to claim 10, wherein said lid has a hingedly mounted edge and said closure member is a tracked fastener mounted peripherally to said lid opposite to said hingedly mounted edge.

12. The pack according to claim 11, wherein said tracked fastener is a zipper.

13. The pack according to claim 4, wherein:

said lid is moveable to a closed position relative to said insulated compartment;

said lid has an inside surface facing said insulated compartment when said top portion is in said closed position and has a peripheral bead formed thereabout, said bead extending downwardly relative to said inside surface of said top when said top portion is in said closed position; and said sidewall member has an upwardly extending peripheral bead formed thereabout, said upwardly extending bead standing in opposition to said downwardly extending bead of said lid when said lid is in said closed position.

14. The pack according to claim 13, wherein said inside surface of said lid is reflective.

15. The pack according to claim 4, wherein:

said leading portion has an upper region proximate to said top portion and a lower region proximate to said bottom portion of said flexible soft shell wall structure; and said upper region of said leading portion has a lateral reinforcing band mounted thereto, said lateral reinforcing band extending between said left and right hand side portions of said sidewall member.

16. The pack according to claim 15, wherein said lifting member is attached to said upper region of said leading portion at an attachment location, said attachment location being reinforced by said lateral reinforcing band.

17. The pack according to claim 4, wherein:

said leading portion has an upper region proximate to said top portion and a lower region proximate to said bottom portion of said flexible soft shell wall structure; and said lower region of said leading portion has a lateral reinforcing band mounted thereto, said extending between said left and right hand side portions of said side wall member.

18. The pack according to claim 4, wherein:

said leading portion has an upper region proximate to said top portion and a lower region proximate to said bottom portion of said flexible soft shell wall structure;

said upper region of said leading portion has an upper lateral reinforcing band extending between said left and right hand side portions of said sidewall members; and said lower region of said leading portion has a lower lateral reinforcing band extending between said left and right hand side portions of said sidewall member.

19. The pack according to claim 4, wherein said lifting member includes a quick release fitting capable of bearing the weight of said pack.

20. The pack according to claim 19 further comprising an attachment member mounted to said leading portion of said sidewall structure, said attachment member being operable to inhibit swaying of said pack about said quick release fitting.

21. The pack according to claim 20, wherein said attachment member is a cinch strap.

22. The pack according to claim 21, wherein said cinch strap has ends mounted to said leading portion of said sidewall member, and vertical left hand and right hand root reinforcements attached to said ends and to said leading portion of said sidewall member.

23. The pack according to claim 4 further comprising left hand side and right hand side lifting fittings mounted, respectively, to said left hand side and said right hand side portions of said side wall member.

24. The pack according to claim 4, wherein said side wall member has a side pocket mounted externally thereon.

25. The pack according to claim 24, wherein said side pocket is a see-through pocket having a web meshing.

26. The pack according to claim 24, wherein said side pocket has a leading edge, a trailing edge and an access lip extending therebetween, wherein said trailing edge is shorter than said leading edge.

27. The pack according to claim 4, wherein said auxiliary compartment has a pocket mounted externally thereon.

28. The pack according to claim 27, wherein said external pocket of said auxiliary compartment has mesh webbing and a sliding closure member operable to control access to said pocket.

29. The pack according to claim 28, wherein said auxiliary compartment pocket has a horizontal upper margin and said sliding closure member is a zipper running along said upper margin.

30. The pack according to claim 4, wherein:

said auxiliary compartment has a first internal receptacle of a size for receiving a telephone handset, and a second internal receptacle of a size for receiving a wallet; and said first internal receptacle has an opening, a flap and a hook and eye fabric closure member, said closure member being operable to secure said flap over said opening of said internal receptacle.

31. The pack according to claim 30, wherein said auxiliary compartment includes a key holder; said key holder having a lanyard secured to said auxiliary compartment.

32. The pack according to claim 4, wherein said insulating compartment has a thermal transfer medium holder mounted therewithin.

33. The pack according to claim 4, wherein:

said auxiliary compartment has a left side wall and a right side wall, said left and right side walls extending away from, said trailing portion of said sidewall member, and an auxiliary compartment trailing wall extending between said left and right hand side walls;

said trailing wall portion has an upper region and a lower region; and said upper region of said trailing wall has an upwardly extending flap, said flap having a detachable margin moveable to an open position to give access to said auxiliary compartment, said flap having an upper margin, a left hand side margin, and a right hand side margin forming an inverted U-shaped boundary along which said auxiliary compartment closure member is mounted.

34. The pack according to claim 33, wherein said auxiliary compartment closure member includes a horizontal hook and eye fabric closure member mounted along said upper margin of said flap, said hook and eye fabric closure member being operable to attach said upper margin to said trailing portion of side wall member.

35. The pack according to claim 34, wherein said flap has zippering along said left and right hand side margins.

* * * * *